US011781329B2

(12) United States Patent
Taylor

(10) Patent No.: US 11,781,329 B2
(45) **Date of Patent: *Oct. 10, 2023**

(54) SEALING CONNECTOR FOR POST TENSIONED ANCHOR SYSTEM

(71) Applicant: Lugo Designs LLC, Hurst, TX (US)

(72) Inventor: Andrea Taylor, Hurst, TX (US)

(73) Assignee: Lugo Designs LLC, Hurst, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/373,628

(22) Filed: Jul. 12, 2021

(65) Prior Publication Data

US 2021/0340782 A1 Nov. 4, 2021

Related U.S. Application Data

(62) Division of application No. 17/061,745, filed on Oct. 2, 2020, now Pat. No. 11,255,096.

(60) Provisional application No. 62/940,146, filed on Nov. 25, 2019.

(51) Int. Cl.

| | |
|---|---|
| ***E04G 21/12*** | (2006.01) |
| ***E04C 5/10*** | (2006.01) |
| ***E04C 5/12*** | (2006.01) |

(52) U.S. Cl.

CPC ..... *E04G 21/125* (2013.01); *E04C 5/10* (2013.01); *E04C 5/122* (2013.01)

(58) Field of Classification Search

CPC ..... E04G 21/125; E04G 21/12; E04C 5/10; E04C 5/122

See application file for complete search history.

(56) References Cited

U.S. PATENT DOCUMENTS

| | | | | | |
|---|---|---|---|---|---|
| 4,821,474 | A | * | 4/1989 | Rodriguez | E04C 5/12 52/223.13 |
| 5,024,032 | A | * | 6/1991 | Rodriguez | E04C 5/12 52/223.13 |
| 5,271,199 | A | | 12/1993 | Northern | |
| 5,749,185 | A | | 5/1998 | Sorkin | |
| 5,775,849 | A | * | 7/1998 | Sorkin | E04C 5/10 405/259.1 |
| 5,788,398 | A | | 8/1998 | Sorkin | |
| 5,839,235 | A | | 11/1998 | Sorkin | |
| 5,939,003 | A | * | 8/1999 | Crigler | E04C 5/12 52/223.13 |
| 5,967,691 | A | * | 10/1999 | Lancelot, III | E04C 5/165 403/313 |
| 6,017,165 | A | | 1/2000 | Sorkin | |
| 6,027,278 | A | | 2/2000 | Sorkin | |
| 6,098,356 | A | | 8/2000 | Sorkin | |

(Continued)

*Primary Examiner* — Rodney Mintz

(74) *Attorney, Agent, or Firm* — Richard A. Fagin

(57) ABSTRACT

A sealing connector cover for a tendon in an encapsulated post-tensioning reinforcement system includes a plurality of circumferential cover segments each comprising a circumferential part of a female connector housing at one longitudinal end, and a male connector housing at another longitudinal end. Each segment has a locking element to engage a corresponding locking element on a longitudinally corresponding segment. Each circumferential segment comprises a circumferential part of a locking element in the female connector housing configured to engage the male connector housing of a longitudinally adjacent sealing connector cover or a connector on an encapsulated anchor.

11 Claims, 7 Drawing Sheets

(56) References Cited

U.S. PATENT DOCUMENTS 6,151,850 A * 11/2000 Sorkin ..... E04C 5/122 52/223.13
6,176,051 B1 * 1/2001 Sorkin ..... E04C 5/08 403/374.1
6,381,912 B1 * 5/2002 Sorkin ..... E04C 5/122 52/223.13
6,560,939 B2 * 5/2003 Sorkin ..... E04C 5/12 52/223.13
6,631,596 B1 10/2003 Sorkin
6,633,000 B2 * 10/2003 Kuo ..... H05K 9/0066 174/92
6,834,890 B2 * 12/2004 Sorkin ..... E04C 5/10 52/223.13
6,874,821 B1 * 4/2005 Sorkin ..... E04C 5/10 52/220.8
7,432,445 B2 * 10/2008 Bird ..... H02G 15/113 174/92
8,839,594 B2 * 9/2014 Smith ..... H02G 3/083 52/220.8
8,931,152 B2 * 1/2015 Parente ..... E04G 21/12 29/253
9,783,987 B2 * 10/2017 Gan ..... E04C 5/0631
9,829,136 B1 * 11/2017 Sorkin ..... E04C 5/10
9,982,434 B1 * 5/2018 Crigler ..... E04C 5/122
10,472,826 B2 * 11/2019 Ki ..... F16B 7/18
10,570,619 B2 * 2/2020 Beaver ..... E04C 5/12
10,634,271 B2 * 4/2020 Sorkin ..... E04C 5/10
10,731,345 B1 * 8/2020 Wilson ..... F16G 11/048
10,745,916 B2 * 8/2020 Hayes ..... E04C 5/163
10,787,813 B2 * 9/2020 Mikulsky ..... E04G 21/12
10,995,494 B2 * 5/2021 Sorkin ..... E04C 5/10
11,035,122 B1 * 6/2021 Sorkin ..... E04C 5/122
11,078,668 B2 * 8/2021 Sorkin ..... E04C 5/10
11,255,096 B2 * 2/2022 Taylor ..... E04G 21/12
2002/0125034 A1 * 9/2002 Kuo ..... H05K 9/0066 174/92
2004/0056483 A1 * 3/2004 Sorkin ..... F16L 25/0018 285/230
2008/0142243 A1 * 6/2008 Bird ..... H02G 15/113 174/92
2012/0266441 A1 * 10/2012 Parente ..... E04G 21/12 29/270
2013/0004232 A1 * 1/2013 Smith ..... H02G 3/088 403/23
2016/0333583 A1 * 11/2016 Gan ..... E04C 5/122
2017/0138050 A1 * 5/2017 Ki ..... F16B 7/18
2017/0227154 A1 * 8/2017 Sorkin ..... F16L 37/248
2019/0323238 A1 * 10/2019 Mikulsky ..... E04C 5/122
2020/0002947 A1 * 1/2020 Hachisuka ..... E04C 5/122
2020/0378121 A1 * 12/2020 Sorkin ..... E04G 21/12
2021/0156161 A1 * 5/2021 Taylor ..... E04C 5/122
2021/0340782 A1 * 11/2021 Taylor ..... E04G 21/125
2022/0195731 A1 * 6/2022 Kohls ..... E04C 5/10

* cited by examiner

SEALING CONNECTOR FOR POST TENSIONED ANCHOR SYSTEM

CROSS REFERENCE TO RELATED APPLICATIONS

Divisional of U.S. application Ser. No. 17/061,745 filed on Oct. 2, 2020. Priority is claimed from U.S. Provisional Application No. 62/940,146 filed on Nov. 25, 2019. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to relates to post-tension concrete reinforcing systems. More particularly, the present disclosure relates to post-tension systems having encapsulated anchors. Furthermore, the present disclosure relates to sealing devices for preventing liquid intrusion into the exposed sections of tendons in the post-tension system.

Reinforced prestressed or post-tensioned concrete structures are known in the art to efficiently use materials to enable longer spans and thinner structural elements. In post-tensioning, high tensile strength metallic or composite strands or tendons are stretched to a certain determined limit after high-strength concrete is placed around them, and subsequently hardened. The reinforcing strand is then stretched by hydraulic jacks and securely anchored into place.

In a typical strand anchor assembly used in such post-tensioning systems, anchors are provided for holding the ends of the tendon suspended therebetween. In the course of tensioning the tendon in a concrete structure, a hydraulic jack or the like is releasably attached to one of the exposed ends of each tendon for applying a predetermined amount of tension to the tendon, which extends through the anchor. When the desired amount of tension is applied to the tendon, wedges or the like are used to capture the strand at the anchor and, as the jack is removed from the tendon, to prevent the tendon's relaxation and to hold it in its stressed condition. Stress in the tendon is thus transferred to the anchor.

There are known post-tension systems having multiple anchorages where the length of the concrete structure is too great to tension with a single anchor. In these systems, an intermediate anchor is interposed between a live end anchor and a dead end anchor at the longitudinal ends of the tendon. In the construction of such systems, the tendon extends for a desired length to the intermediate anchor. A portion of sheathing is removed from the tendon in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After stressing the tendon, concrete is poured over the exterior of the sheathed part of the tendon, and over the dead end anchor and intermediate anchor. The remaining portion of the tendon extends from the intermediate anchor to either another intermediate anchorage or to the live end anchor. Intermediate anchorage systems are used whenever the concrete structure is so long that a single live anchor extending to a dead end anchor is inadequate. For example, two intermediate anchorages may be used for concrete structure having a length of approximately 300 feet or more.

A consideration that affects anchorage systems is the need to effectively prevent liquid intrusion into the unsheathed portion of the tendon. Therefore, it is required that the anchor be sealed to the sheathing in a water-tight manner. Over a substantial portion of the tendon, sheathing may provide the required water exclusion. For the wedges to grip the tendon, however, the sheathing must be partially removed proximate the anchor. The unsheathed portion will extend outwardly from the anchor in the direction of the dead end anchor. Another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. See, for example, U.S. Pat. No. 6,631,596 issued to Sorkin. This is relatively easy to accomplish at the live end of the tendon since the length of the tendon is minimal at the live end anchor. However, it is difficult to slide such a tubular member along the entire length of the tendon so as to form the liquid-tight seal at the intermediate anchorage. It is known in the art to use tape, or other corrosion protection materials applied to the exposed portion of the tendon adjacent the intermediate anchorage. Additionally, it is known in the art that sheathing is prone to shrinkage due to thermal change and stress relief. This shrinkage may be of a magnitude that causes the sheathing to retract out of a seal of a tubular member. Extensive practice with this technique has shown that it is generally ineffective for preventing liquid intrusion into the interior of the tendon or into the interior of the intermediate anchorage. As a result, a need has developed in which to protect the exposed areas of the tendon adjacent any anchorage regardless of location.

Conventionally, in order to install great lengths of tendon with sealed intermediate anchorage systems, it is necessary to thread the anchor and sealing tubular member along the length of the tendon so as to place the anchor in a desired position. A tendon sealing system known in the art is illustrated in FIG. 4. The system comprises two sealing tubes that may be attached to the anchor, but must be "threaded" over the tendon. The system shown in FIG. 4 may be used with unencapsulated anchors. Often during this "threading" of the tubular member, seals are damaged or compromised. Often, components of the anchorage system are omitted or the installation is carried out in an ineffective manner because of the large amount of manipulation that is required for the installation of the system. Inherently, each of the intermediate anchors will be located in a joint of the concrete structure; therefore, each of the anchors will be exposed to corroding elements. The liquid resistance of the tubular seals in known anchorage systems must be particularly good so as to prevent any damage to the exposed portions of the tendon. Another example is shown in FIG. 5, which is disclosed in Sorkin, U.S. Pat. No. 5,749,185.A corresponding system for encapsulated anchors is shown in FIG. 6, which is disclosed in Sorkin, U.S. Pat. No. 5,788,398.

Further, the seating of dead, or fixed end anchors for encapsulated systems requires that the wedge and strand be pushed into the anchor with great force. This requires specialized hydraulic equipment and is somewhat unreliable in making a reliable connection between the tendon, wedge, and anchor. An example of a sealing tube disposed over a tendon at the dead end is shown in FIG. 5. The dead end anchor may comprise a seal cap over the cut end of the tendon extending through the wedge receiving bore side of the anchor. Because of the threaded tubes and seals, a more reliable method of pulling the strand and wedge into the anchor is impractical, so a need has arisen for a sealing device that can be segmentally attached to the anchor and tendon after the dead, or fixed end is applied to the tendon in a fabrication plant. It will be appreciated that the anchor, seal tube and cap shown in FIG. 5 are also illustrative of a live end anchor A cross sectional view of a sheathed tendon passing through an encapsulated anchor is shown in FIG. 7, which is disclosed in Sorkin, U.S. Pat. No. 5,839,235. An encapsulated anchor having retaining features for a seal cap or a further seal to engage a tendon when the anchor is used as a live end or intermediate anchor, and a seal extension tube when the anchor is used as an intermediate anchor is shown in FIG. [[9]]8, which is disclosed in Sorkin, U.S. Pat. No. 6,089,356.

In known forms of installing encapsulated post-tension reinforcing systems, the tubular seal will be joined to the anchor by various forms of connector. Travel of the close-fitting tubular seal along the length of the tendon during installation may cause the sealing capability to become compromised and may lead to the release of the tendon.

SUMMARY

A method for post-tensioning a concrete structure according to one aspect of the present disclosure includes assembling a tendon to a first anchor. The tendon is passed through an encapsulated second anchor. A first circumferentially segmented sealing connector cover is assembled to the tendon and to the first anchor. A second circumferentially segmented sealing connector is assembled to the tendon and to the encapsulated second anchor. Concrete is poured into a form surrounding the tendon. The concrete is allowed to cure, and the tendon is stretched to a predetermined tension.

Some embodiments further comprise connecting a third circumferentially segmented sealing connector cover to a free end of the first circumferentially segmented sealing connector cover.

In some embodiments, each of the first and the second circumferentially segmented sealing connector cover comprises a plurality of circumferential cover segments. Each such segment comprises a circumferential part of a female connector housing at one longitudinal end, and a male connector housing at another longitudinal end. Each circumferential cover segment has a locking element to engage a corresponding locking element on a longitudinally corresponding circumferential cover segment. Each circumferential cover segment comprises a circumferential part of a locking element in the female connector housing configured to engage the male connector housing of a longitudinally adjacent sealing connector cover or a connector on an encapsulated anchor.

In some embodiments, each circumferentially segmented sealing cover further comprises in each circumferential segment a circumferential part of an internal seal to sealingly engage the tendon.

In some embodiments, each circumferentially segmented sealing cover further comprises in each circumferential segment a circumferential part of an internal seal to sealingly engage the male connector housing of the longitudinally adjacent sealing connector cover or the connector on an encapsulated anchor.

In some embodiments, each circumferentially segmented sealing cover further comprises in each circumferential segment a circumferential part of one or more gripping elements to engage the tendon.

In some embodiments, one circumferential edge of each circumferential segment comprises a hinge.

In some embodiments, each circumferential segment is made from a flexible material.

A sealing connector cover for a tendon in an encapsulated post-tensioning reinforcement system according to another aspect of the present disclosure comprises a plurality of circumferential cover segments each having a circumferential part of a female connector housing at one longitudinal end, and a circumferential part of a male connector housing at another longitudinal end. Each circumferential cover segment has a locking element to engage a corresponding locking element on a longitudinally corresponding circumferential cover segment. At least one of the plurality of circumferential cover segments comprises a part of a locking element in the female connector housing configured to engage either (i) the male connector housing of a longitudinally adjacent sealing connector cover or (ii) encapsulation on an encapsulated anchor.

Some embodiments further comprise in each circumferential segment a circumferential part of an internal seal to sealingly engage a tendon passed through an anchor.

Some embodiments further comprise in each circumferential segment a circumferential part of an internal seal to sealingly engage the male connector housing of the longitudinally adjacent sealing connector cover or locking feature on the encapsulation of the encapsulated anchor.

Some embodiments further comprise in each circumferential segment a circumferential part of one or more gripping elements to engage a tendon passed through the sealing connector cover.

In some embodiments, one circumferential edge of each circumferential cover segment comprises a hinge.

In some embodiments, each circumferential segment is made from a flexible material.

DETAILED DESCRIPTION

The present disclosure provides a post-tension anchor sealing connector and connector system. In the system, a tendon having a sheathed portion and unsheathed portion, a first anchor receiving the unsheathed portion of the tendon therein, a second anchor receiving another unsheathed portion of the tendon therein, a potential for a plurality of intermediate anchors requiring the removal of protective sheathing are arranged to stress the tendon. Each anchor is protected by a corrosion protection cover (encapsulation) capable of receiving attachments such as caps and sheathing sealing connections to form a complete liquid tight assembly.

Figure 1:
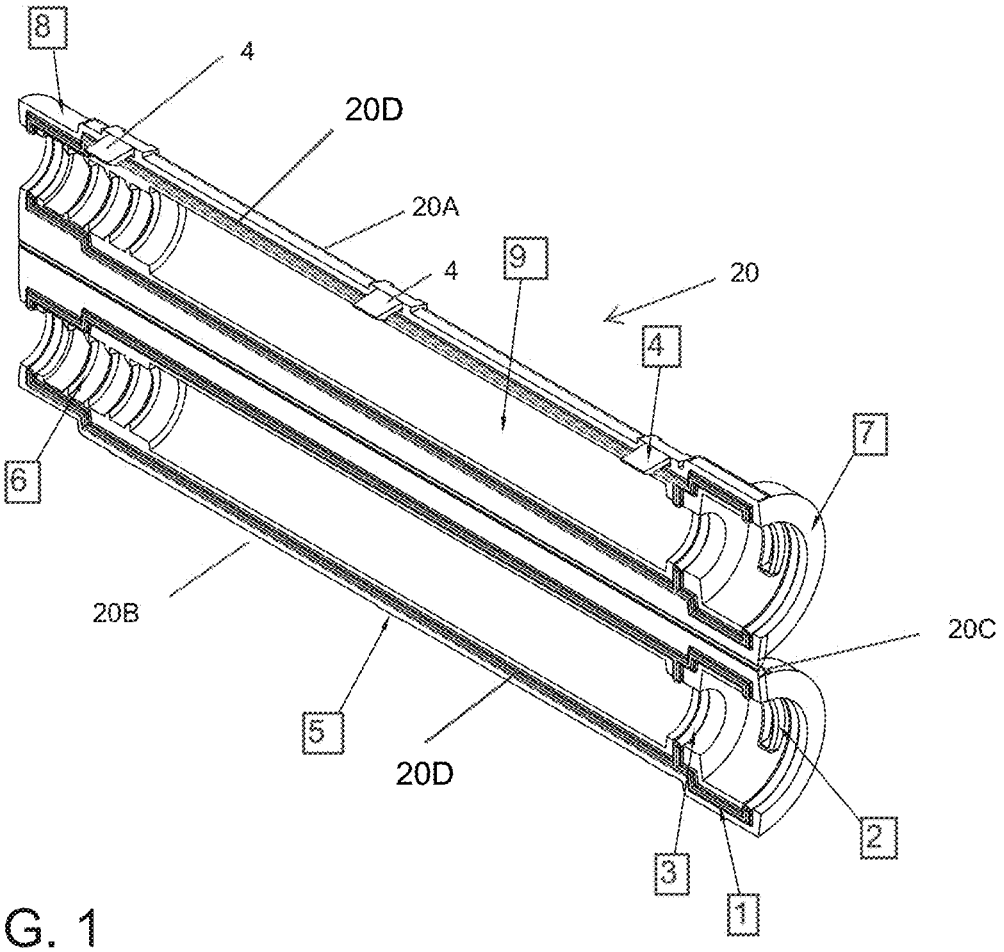
FIG. 1 shows an oblique view of an example embodiment of an end seal according to the present disclosure.
Figure 2A:
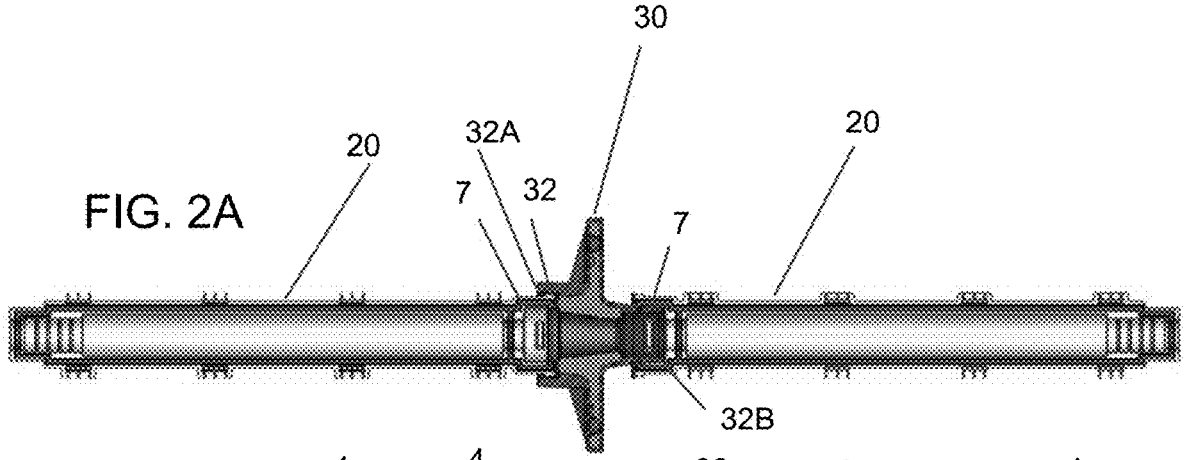
FIGS. 2A, 2B and 2C show, respectively a top, bottom, and side view of an example embodiment of an end seal connected to both sides of an intermediate anchor system.
Figure 2B:
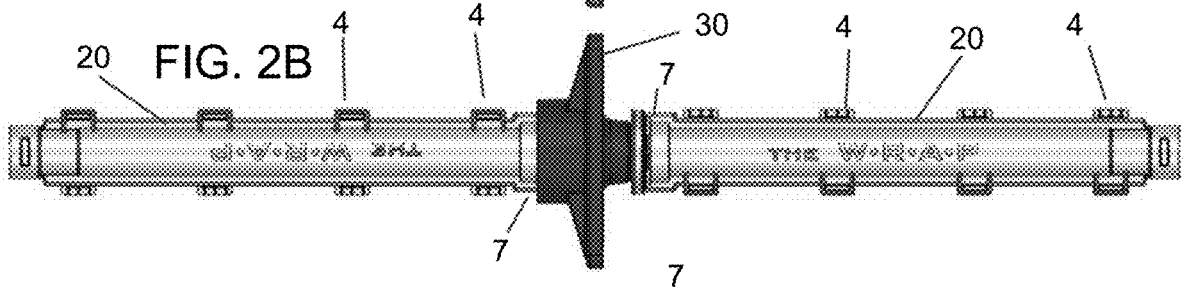
Figure 2C:
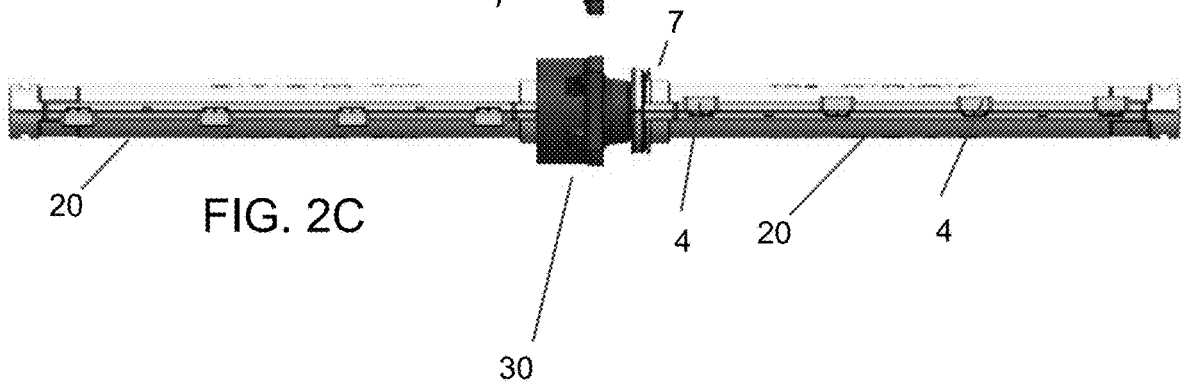
Figure 2D:
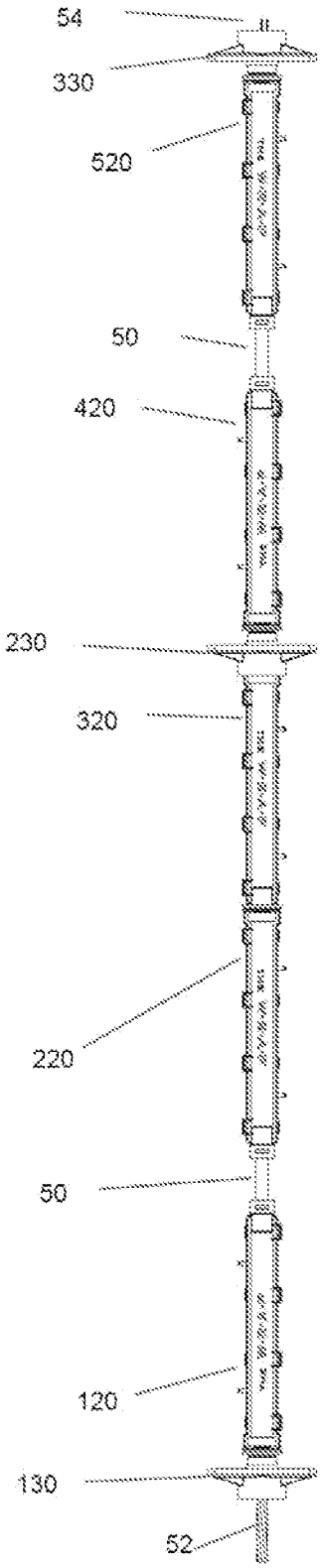
FIG. 2D shows assembled sealing connector covers, encapsulated anchors and stripped sections of a sheathed tendon in accordance with the present disclosure.

In some embodiments, and referring to FIG. 2D, a respective unsheathed portion, shown at 52 and 54 of the tendon 50 is secured within the tendon-receiving cavity of each of the plurality of anchors 130, 230, 330 by wedges or the like. The encapsulated anchors 130, 230, 330 have an exterior connection point or feature to receive the sealing connector cover, 120, 220, 320, 420, 520. The sealing connector cover is affixed in liquid-tight relationship to the encapsulation on the anchor, e.g., at 132 and 120 in FIG. 2D and the sheathing on the tendon, shown at 50. The sealing connector cover e.g., at 120, 220, has sufficient length to cover all of the unsheathed portions of the tendon 50 extending from the encapsulated anchor 130, 230. The sealing connector cover e.g., 120 and explained in more detail with reference to FIGS. 1 and 2C may be a hinged, flexible or two-part assembly allowing connections to be made without threading the sealing connector cover over the length of the tendon from a free end thereof.

The sealing connector cover 120, 220, 32, 420, 520 can be attached to the stressing (live) end of the tendon 50 and associated anchor, the fixed (dead) end of the tendon 50 and associated anchor, or at and to any intermediate anchor(s). Further, more than one sealing connector cover may be assembled on the tendon end e.g., at 220 and 320 to end by way of interlocking end connections, allowing either end-to-end connection of multiple sealing connector covers or connection of a sealing connector cover to any anchor. This stackable, interconnecting design allows any suitable length of exposed strand or tendon to be covered without threading. Additionally, the sealing connector cover may be used at any point along the strand or tendon where sheathing may be damaged and repair is necessary to prevent moisture intrusion into the tendon.

In some embodiments, the sealing connector cover may be formed as two symmetrical, longitudinal halves of a tubular member connected to each other by a hinge, and fasteners to hold the sealing connector cover closed onto an anchor and/or a tendon. The halves may have longitudinal and circumferential seals to prevent liquid intrusion into the cover once it is installed on the tendon. One end of the sealing connector cover may be formed to make a mechanical and liquid tight connection to the anchor, while the opposite end is configured to make a liquid tight seal and positive connection to the sheathing, and, if desired, to an additional sealing connector cover coupled end to end. The sealing connector cover may therefore be configured to receive an additional sealing connecting connector cover at the other end. The interior of the sealing connector cover may be filled with an appropriate volume of corrosion inhibitor such as grease, microcrystalline wax, silicone gel or the like in order to fill any voids where moisture could collect, thereby providing an additional protective barrier.

The present disclosure also provides a method of forming an encapsulated tendon, and anchorage for a post-tension concrete reinforcing system comprising: (1) encapsulating an anchor within an encapsulation thereon; (2) positioning a tendon within the anchor; (3) seating a wedge or the like around an unsheathed portion of the tendon and within the tendon-receiving cavity of the anchor; (4) affixing a sealing cap over the exposed wedge or the like within the tendon-receiving cavity of the anchor in the case of a live end anchor, or securing a sealing connector cover to the wedge end of the tendon and to the anchor for an intermediate anchor; and (5) securing a sealing connector cover to the anchor such that the tendon is sealed from end-to-end through the anchor.

An example embodiment of a sealing connector cover, that may be used with a known encapsulated anchor and post-tensioning system, is shown in oblique view in FIG. 1 at 20. An encapsulated anchor, tendon and locking wedges used in such anchoring system may be any types known in the art, for example and without limitation those shown in U.S. Pat. No. 6,631,596 issued to Sorkin (also shown in FIG. 3). The sealing connector cover 20 may be made from any suitable material known to be used for encapsulated anchor systems, for example and without limitation plastic such as thermoplastic or thermoset plastic. Some embodiments may be made from flexible plastic.

The present example embodiment of the sealing connector cover 20 may be formed from two circumferential half-sections 20A, 20B connected along their respective length by a hinge 20C. One or more male locks 4 may be disposed along the circumferential edge of one of the half-sections, e.g., 20A that mate with and lockingly engage one or more corresponding female lock(s) 5 disposed at corresponding longitudinal positions along the other half-section 20B. It will be appreciated by those skilled in the art that the hinge 20C may be substituted by or supplemented with additional locks on the opposed circumferential edge of each of the half-sections 20A, 20B. Some embodiments may be made from flexible material such as flexible plastic so as to eliminate the need for the hinge 20C as will be explained further below. While the present example embodiment comprises two circumferential sections 20A, 20B, other embodiments may comprise more circumferential sections, e.g., three or four circumferential sections each having corresponding features.

Some embodiments of a sealing connector cover 20 may be made from a flexible material (e.g., flexible plastic) such that the hinge 20C may be omitted. In such embodiments, the circumferential half sections 20A, 20B may be separated by folding along a line disposed where the hinge 20C is shown in FIG. 1, or the circumferential half sections 20A, 20B may be separated only along a single parting line 20D. Such embodiments may be opened for affixing to the tendon and anchor by urging the circumferential half sections 20A, 20B apart along the parting line 20D until an opening between the ends of the circumferential half sections 20A, 20B is wide enough to fit over the tendon (not shown). It will be apparent that while the present description is made with reference to circumferential half sections, embodiments which omit the hinge 20C and may be opened by urging away from a parting line may be formed as a single, circumferential part having the parting line define the only plane of separation of the circumferential segments 20A, 20B.

Figure 3:
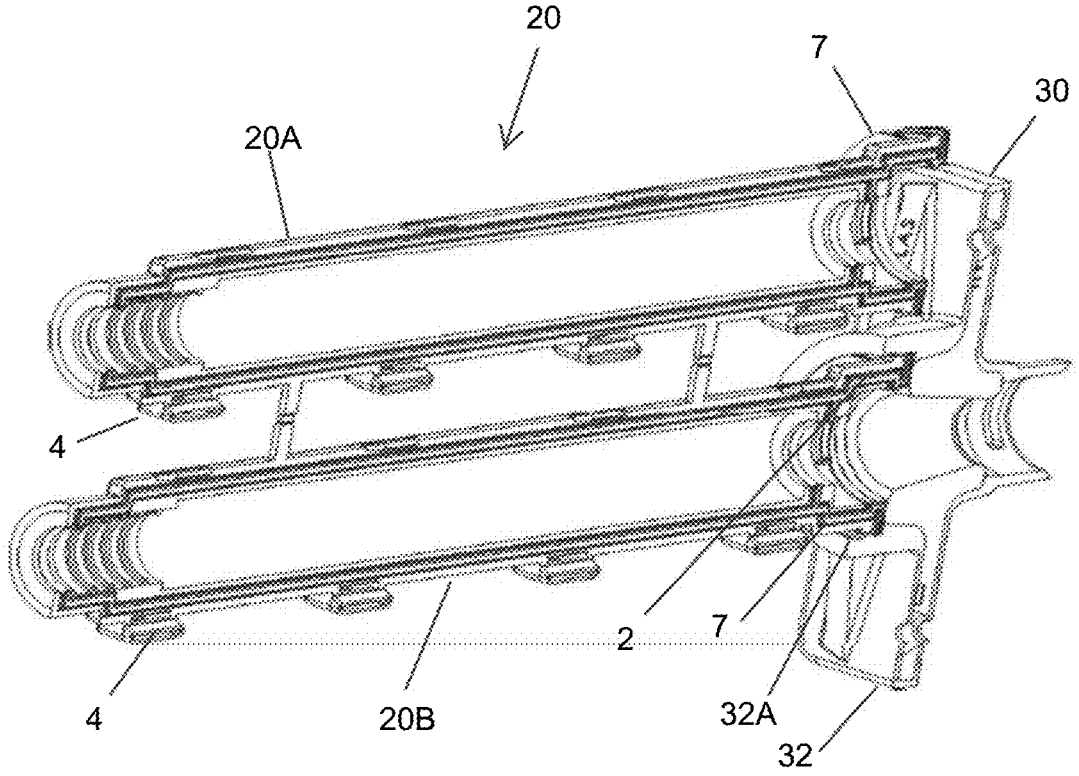
FIG. 3 shows an oblique view of an example embodiment of an open end seal according to the present disclosure attached to a section drawing of an encapsulated anchor shown in section drawing.
Figure 4:
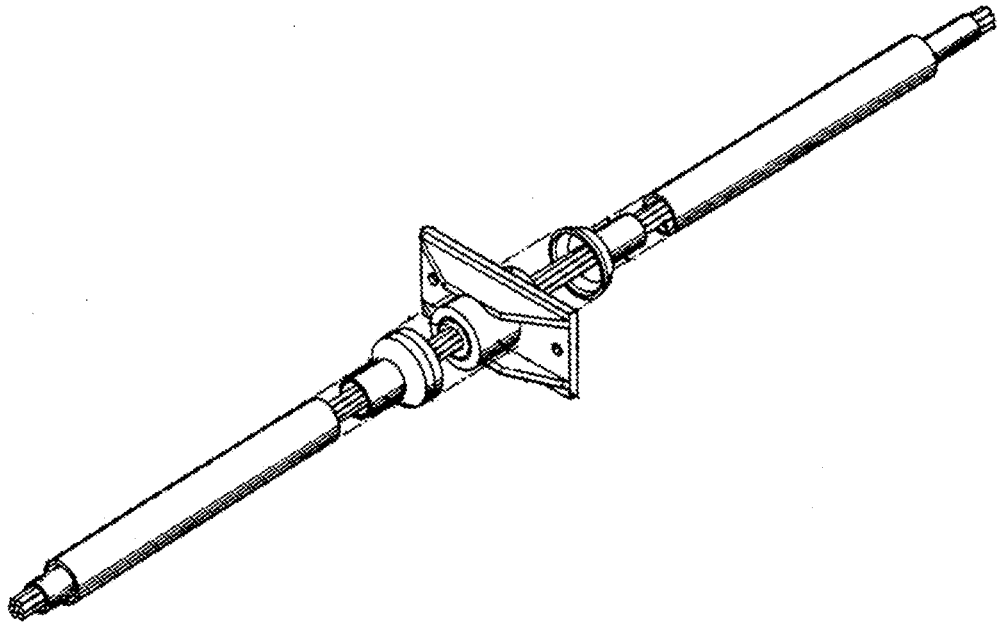
FIG. 4 (PRIOR ART)
FIGS. 4 through 8 show various tendon and anchor encapsulation devices known in the art to help explain various features of a sealing connector and system according to the present disclosure
Figure 5:
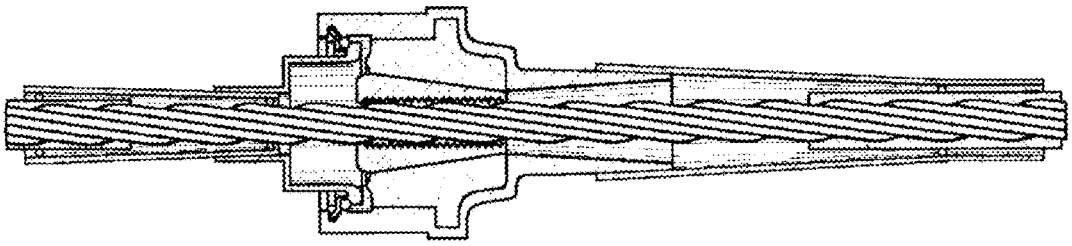
FIG. 5 (PRIOR ART)

Each circumferential section 20A, 20B may comprise at one longitudinal end a circumferential segment of a female coupling housing 7 shaped to receive therein, when the circumferential sections 20A, 20B are joined, a male coupling housing 8 disposed at the other longitudinal end of the sealing connector cover 20. The female coupling housing 7 may comprise a locking element 2 shaped to engage a corresponding locking element (not shown) formed in the male coupling housing 8. A locking element (not shown)

corresponding to the locking element (not shown) in the male coupling housing 8 may be similarly formed in a male locking element (not shown) formed in an encapsulation about a post-tensioning anchor (30 in FIG. 3). The locking element 2 can thus be connected to either an adjacent sealing connector cover or to an encapsulated anchor (30 in FIG. 3). Correspondingly, any chosen number of sealing connector covers may be joined end to end to cover any selected length of tendon.

The female coupling housing 7 may comprise a first internal seal 3 having an inner diameter, when the sections are joined, chosen to sealingly engage a tendon (not shown in the figures) passing through the sealing connector cover 20. The female connector housing 7 may also comprise a second internal seal 1 having an internal diameter chosen to sealingly engage the male coupling housing 8 or the encapsulated anchor (not shown). The sealing connector cover 20 may further comprise one or more gripping elements 6 on the internal surface such that the gripping elements 6 engage an exterior surface of the tendon (not shown) when the sealing connector cover 20 is assembled to the tendon (not shown).

FIGS. 2A, 2B and 2C show, respectively a top cut away view, a bottom view, and a side view of an example embodiment of sealing connector cover 20 connected to both sides of an intermediate anchor 30. While the embodiment shown in FIGS. 2A, 2B and 2C are shown connected to an intermediate anchor, the sealing connector cover 20 may be used on dead end and live end terminal anchors. The intermediate anchor 30 may comprise encapsulation 32 of types known in the art. On the left hand side of the anchor 30 in FIG. 2A, it may be observed that the female coupling housing 7 engages an internal feature 32A in the wedge receiving bore side of the encapsulation 32. Such feature 32A may be similar to features known in the art for connecting pocket formers and encapsulating devices to such side of an encapsulated anchor. The sealing connector cover 20 on the right hand side in FIG. 2A may be observed coupled to the exterior 32B of the encapsulation 32 as may be the case for seals known in the art prior to the present disclosure. It should be understood that such prior art seals must be affixed to the anchor prior to insertion of the tendon through the anchor. As explained above, a sealing connector cover according to the present disclosure may be affixed to the anchor 30 while the tendon (not shown) is already in place through the anchor 30. The tendon is omitted from the views in FIGS. 2A, 2B and 2C for clarity of the illustration, it being understood that in use, a tendon will be in place through the anchor at the time the sealing end connector(s) may be affixed to the anchor and the tendon.

Figure 6:
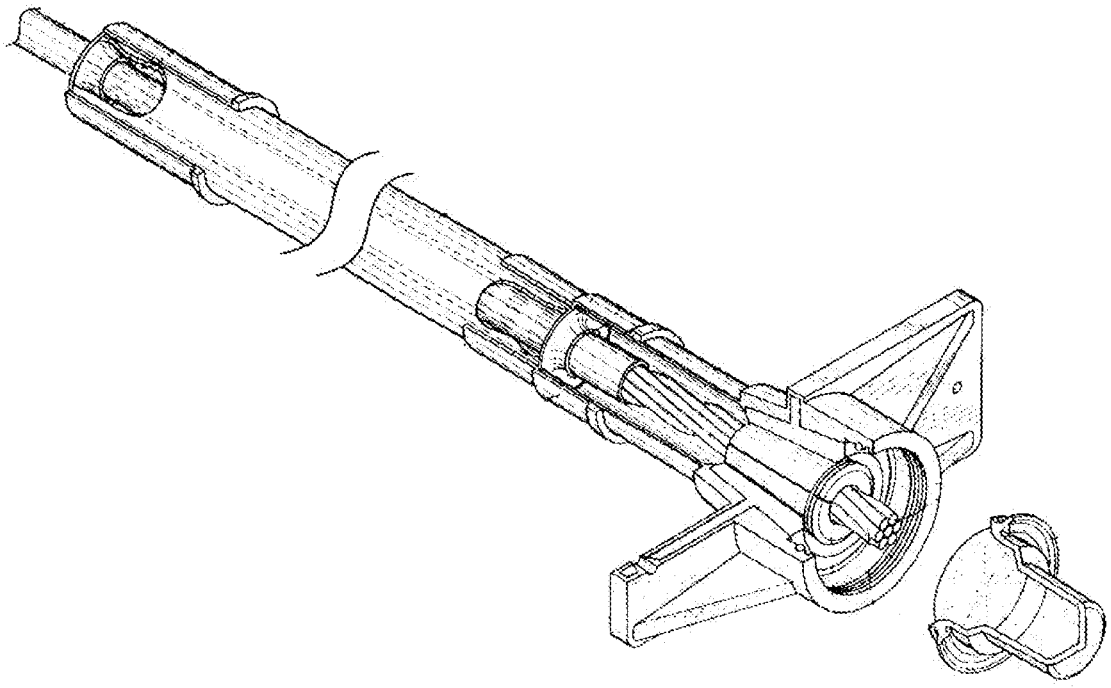
FIG. 6 (PRIOR ART)
Figure 7:
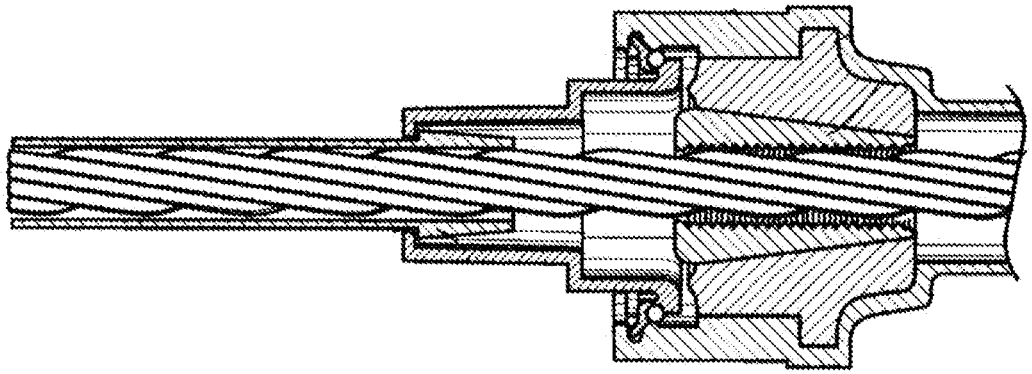
FIG. 7 (PRIOR ART)
Figure 8:
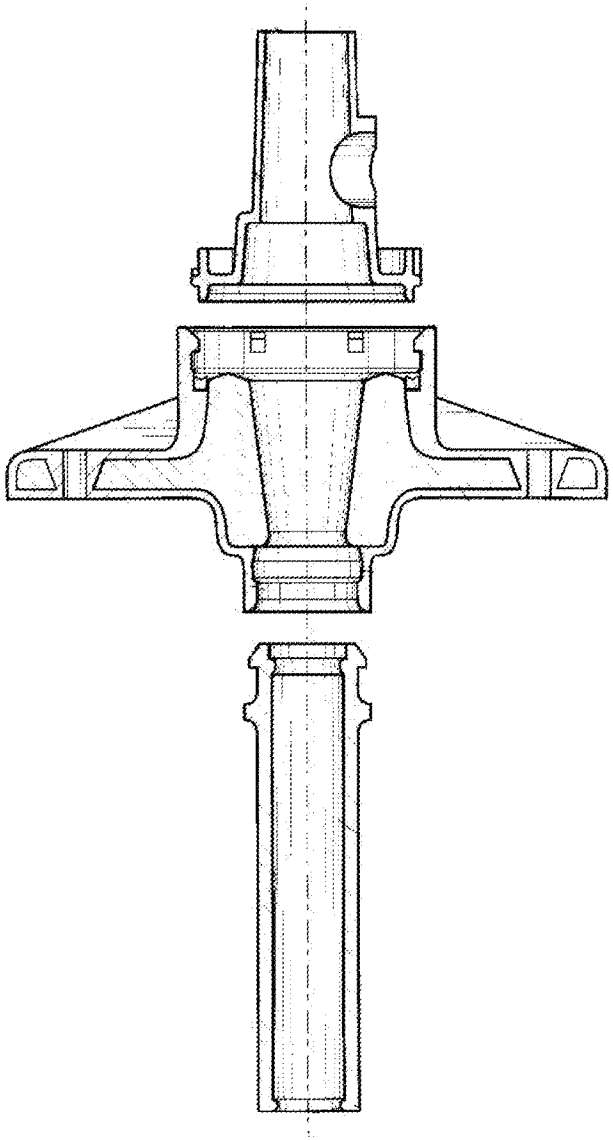
FIG. 8 (PRIOR ART)

FIG. 3 shows an oblique view of an example embodiment of sealing connector cover 20 according to the present disclosure attached to an encapsulated anchor 30 shown in section drawing. The sealing connector cover 20 is shown with the circumferential segments 20A, 20B open, so that connection to the encapsulation feature 32A using the locking element 2 may be better observed. An example of the encapsulation feature 32A may be more clearly observed in FIG. 6.

In a method of assembling a post-tensioning system according to one aspect of this disclosure, a tendon may be assembled to a dead end anchor at one end of a concrete structure form. Assembling the tendon may comprise removing part of the sheath from the tendon and attaching a sealing connector cover 20 to the part of the tendon extending through the dead end anchor as explained above. The tendon may be assembled to one or more intermediate anchors and/or to a live end anchor. Concrete may then be poured into the form and allowed to cure. The tendon may be stretched and seated in the intermediate anchor(s) and/or the live end anchor, and a sealing connector cover 20 assembled to the tendon as explained above. Where required, more than one sealing connector cover may be assembled to the free end of any one or more of the sealing connector covers to fully enclose any unsheathed part of the tendon that may extend out from any of the free ends. Thus, all exposed tendon will be fully enclosed inside sealed encapsulation. As will be appreciated, the sealing connector covers may be filled with grease or other corrosion inhibitor prior to assembly to the tendon and/or anchors.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for post-tensioning a concrete structure, comprising:

assembling a tendon to a first anchor;

passing the tendon through an encapsulated second anchor;

assembling a first circumferentially segmented sealing connector cover to the tendon and to the first anchor;

assembling a second circumferentially segmented sealing connector directly to the tendon and to the encapsulated second anchor;

wherein each of the first and the second circumferentially segmented sealing connectors cover comprises a plurality of circumferential cover segments each comprising a circumferential part of a female connector housing at one longitudinal end, and a male connector housing at another longitudinal end, each circumferential cover segment having a first locking element to engage a corresponding first locking element on a longitudinally corresponding circumferential cover segment; and wherein each circumferential cover segment comprises a circumferential part of a second locking element in the female connector housing configured to engage the male connector housing of a longitudinally adjacent sealing connector cover or a connector on the encapsulated anchor pouring concrete into a form surrounding the tendon;

allowing the concrete to cure; and stretching the tendon to a predetermined tension.

2. The method of claim 1 further comprising connecting a third circumferentially segmented sealing connector cover to a free end of the first circumferentially segmented sealing connector cover.

3. The method of claim 1 wherein each circumferentially segmented sealing cover further comprises in each circumferential segment a circumferential part of an internal seal to sealingly engage the tendon.

4. The method of claim 1 wherein each circumferentially segmented sealing cover further comprises in each circumferential segment a circumferential part of an internal seal to sealingly engage the male connector housing of the longitudinally adjacent sealing connector cover or the connector on the encapsulated anchor.

5. A method for post-tensioning a concrete structure, comprising:

removing a first part of a sheath from a sheathed tendon;

assembling the first part of the tendon to a first anchor;

removing a second part of the sheath from the sheathed tendon;

passing the second part of the sheathed tendon through an encapsulated second anchor;

assembling a first circumferentially segmented sealing connector cover directly to the tendon and directly to the first anchor so as to enclose the first part;

assembling a second circumferentially segmented sealing connector directly to the tendon and directly to the encapsulated second anchor so as to enclose the second part wherein each of the first and the second circumferentially segmented sealing connectors cover comprises:

a plurality of circumferential cover segments each comprising a circumferential part of a female connector housing at one longitudinal end, and a male connector housing at another longitudinal end, each circumferential cover segment having a first locking element to engage a corresponding first locking element on a longitudinally corresponding circumferential cover segment, and wherein each circumferential cover segment comprises a circumferential part of a second locking element in the female connector housing configured to engage the male connector housing of a longitudinally adjacent sealing connector cover or a connector on the encapsulated anchor;

pouring concrete into a form surrounding the tendon;

allowing the concrete to cure; and after the concrete cures, stretching the tendon to a predetermined tension.

6. The method of claim 5 further comprising connecting a third circumferentially segmented sealing connector cover to a free end of the first circumferentially segmented sealing connector cover.

7. The method of claim 5 wherein each circumferentially segmented sealing cover further comprises in each circumferential segment a circumferential part of an internal seal to sealingly engage the tendon.

8. The method of claim 5 wherein each circumferentially segmented sealing cover further comprises in each circumferential segment a circumferential part of an internal seal to sealingly engage the male connector housing of the longitudinally adjacent sealing connector cover or the connector on the encapsulated anchor.

9. The method of claim 5 wherein each circumferentially segmented sealing cover further comprises in each circumferential segment a circumferential part of one or more gripping elements to engage the tendon.

10. The method of claim 5 wherein one circumferential edge of each circumferential segment comprises a hinge.

11. The method of claim 5 wherein each circumferential segment is made from a flexible material.

* * * * *